US008508419B2

(12) United States Patent
Petrucci et al.

(10) Patent No.: US 8,508,419 B2
(45) Date of Patent: Aug. 13, 2013

(54) MULTIPLE ANTENNA ELEMENT SYSTEM AND METHOD

(75) Inventors: David R. Petrucci, Warren, MI (US); Charles A. Massoll, Milford, MI (US); Donald B. Hibbard, Jr., Howell, MI (US); Nathan C. Callaghan, Fenton, MI (US); Mark A. Wisnewski, Stockbridge, MI (US); David J. Trzcinski, Howell, MI (US); Steven P. Schwinke, Plymouth, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 384 days.

(21) Appl. No.: 12/910,409

(22) Filed: Oct. 22, 2010

(65) Prior Publication Data

US 2012/0098717 A1 Apr. 26, 2012

(51) Int. Cl.
*H01Q 1/32* (2006.01)

(52) U.S. Cl.
USPC ..... 343/713; 343/711

(58) Field of Classification Search
USPC ..... 343/711, 712, 713, 714, 715
See application file for complete search history.

(56) References Cited

U.S. PATENT DOCUMENTS

| | | | | |
|---|---|---|---|---|
| 5,959,584 | A | 9/1999 | Gorham et al. | |
| 6,351,242 | B1 | 2/2002 | Hesker | |
| 6,757,267 | B1 | 6/2004 | Evans et al. | |
| 7,064,721 | B2 | 6/2006 | Zafar et al. | |
| 7,546,146 | B2 | 6/2009 | Sievenpiper et al. | |
| 2001/0038355 | A1 * | 11/2001 | Fuchs et al. | 343/713 |
| 2004/0217906 | A1 * | 11/2004 | Ishibayashi et al. | 343/713 |
| 2010/0164790 | A1 | 7/2010 | Wisnewski et al. | |
| 2010/0202353 | A1 | 8/2010 | Talty et al. | |
| 2011/0279337 | A1 * | 11/2011 | Corwin et al. | 343/713 |
| 2011/0298677 | A1 | 12/2011 | Petrucci et al. | |
| 2011/0298678 | A1 | 12/2011 | Petrucci et al. | |

FOREIGN PATENT DOCUMENTS

| | | | |
|---|---|---|---|
| DE | 19736054 | A1 | 9/1998 |
| DE | 19841187 | C1 | 2/2000 |
| DE | 19962736 | A1 | 7/2001 |
| DE | 10113285 | A1 | 10/2002 |
| DE | 10139406 | A1 | 2/2003 |
| DE | 102004035231 | A1 | 2/2006 |
| DE | 102006039357 | A1 | 3/2007 |
| DE | 102007039914 | A1 | 2/2009 |
| DE | 102008057520 | A1 | 7/2009 |

* cited by examiner

*Primary Examiner* — Hoanganh Le

(57) ABSTRACT

An antenna system connectable to a vehicle includes a primary antenna, a primary data transmission line, a secondary antenna, a secondary data transmission line, and an RF device. The primary antenna is connected to the vehicle and is located in an exterior environment. The secondary antenna is connected to the vehicle and is located in one of the exterior environment and an interior cabin of the vehicle. The primary data transmission line transmits a first RF signal and is in communication with the primary antenna. The secondary data transmission line transmits a secondary RF signal and is in communication with the secondary antenna. The fixed RF device is connected to the vehicle and is in communication with the primary data transmission line and the secondary data transmission line to provide an output RF signal.

20 Claims, 2 Drawing Sheets

MULTIPLE ANTENNA ELEMENT SYSTEM AND METHOD

FIELD

The present invention relates to a system and method of communicating radio frequency (RF) signals from multiple antennas, and more particularly to a system and method of communicating RF signals from a primary antenna and a secondary antenna.

BACKGROUND

The statements in this section merely provide background information related to the present disclosure and may or may not constitute prior art.

Consumers frequently use personal electronic devices such as cellular telephones in their vehicles. However, the metal body of vehicles can act as a shield and can block some of the radio frequency (RF) signals from entering the interior cabin of the vehicle. As a result, if a portable electronic device is being used within the interior cabin of the vehicle, RF signals such as cellular telephone signals or global positioning system (GPS) signals can sometimes be weak. Moreover, certain government mandated vehicle regulations require passenger vehicles to use solar management glass coatings. This type of glass coating causes less infrared energy to be transmitted into the interior cabin of the vehicle, which in turn reduces the heat load in the interior cabin of the vehicle. However, this coating may also attenuate RF signals that travel through the glass.

Vehicle antennas are typically mounted on an exterior surface of a vehicle and are employed to communicate RF signals. Exterior vehicle antennas are usually mounted on the roof, trunk, or rear glass of the vehicle. Because the exterior antenna is mounted on the outside of the vehicle, the exterior antenna may be especially susceptible to damage during a vehicle crash, or can be broken off unintentionally or intentionally. An inoperable or missing exterior antenna may cause wireless communication to be unavailable for in-vehicle wireless communication systems such as OnStar®. For example, during a roll-over accident the exterior antenna may be crushed if located on the roof of the vehicle, thereby leaving in-vehicle wireless communication systems inoperable. Accordingly, there is a need in the art for a more reliable antenna system that effectively communicates RF signals.

SUMMARY

An antenna system connectable to a vehicle having an interior cabin is provided. An external RF device is located exterior to the vehicle. A control module is mounted in the vehicle and receives an output RF signal from the antenna system. The antenna system includes a primary antenna and a secondary antenna. The primary antenna is connected to the vehicle and located in the exterior environment. The primary antenna transmits and receives a first RF signal to and from the external RF device. A primary data transmission line for transmitting the first RF signal is also provided, where the primary data transmission line is in communication with the primary antenna. The secondary antenna is connected to the vehicle and located in one of the exterior environment and the interior cabin. The secondary antenna transmits and receives a second RF signal to and from the external RF device located in the exterior environment. A secondary data transmission line for transmitting the second RF signal is provided, where the secondary data transmission line is in communication with the secondary antenna. A fixed RF device is connected to the vehicle and in communication with the primary data transmission line and the secondary data transmission line. The fixed RF device provides the output RF signal that is based on at least one of the first RF signal and the second RF signal.

In one embodiment of the present invention, the fixed RF device is an RF coupler for combining the first RF signal and the second RF signal to create the output RF signal.

In another embodiment of the present invention, the fixed RF device is an RF switch for selecting the one of the first RF signal and the second RF signal as the output RF signal.

In still another embodiment of the present invention, the fixed RF device is a combined RF switch and an RF coupler. The fixed RF device operates as an RF switch if the RF signals from one of the first RF signal and the second RF signal is unavailable. The fixed RF device operates as an RF coupler when the RF signals from both the first data transmission line and the second data transmission are available.

In yet another embodiment of the present invention, the primary antenna is located on one of a roof of the vehicle, a cowl base, a side rearview mirror, a head lamp, a tail lamp, Center High Mounted Stop Lamps (CHMSL), a front windshield, a rear windshield, a sunroof, a deck lid, and a bumper.

In still another embodiment of the present invention, the secondary antenna is located on one of a roof of the vehicle, a cowl base, a side rearview mirror, a head lamp, a tail lamp, Center High Mounted Stop Lamps (CHMSL), a front windshield, a rear windshield, a sunroof, a deck lid, and a bumper.

In yet another embodiment of the present invention, the secondary antenna is located within the interior cabin of the vehicle, and on one of a vehicle overhead console, a vehicle center console, an instrument panel, an A pillar, a B pillar, a C pillar, a D pillar, an integrated center stack faceplate, a front windshield, a rear windshield, a sunroof, interior seats and a dome light.

In still another embodiment of the present invention, the fixed RF device is in communication with the control module through a third data transmission line.

In yet another embodiment of the present invention, the primary antenna and the secondary antenna are each integrated antennas including several different antenna elements, and receive and transmit global positioning signals (GPS) and cellular signals.

In still another embodiment of the present invention, at least one of the primary antenna and the secondary antenna are passive antennas.

In yet another embodiment of the present invention, the data transmission line is a coaxial cable.

In still another embodiment of the present invention, the secondary antenna is in bidirectional communication with an interior RF device located within the interior cabin.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
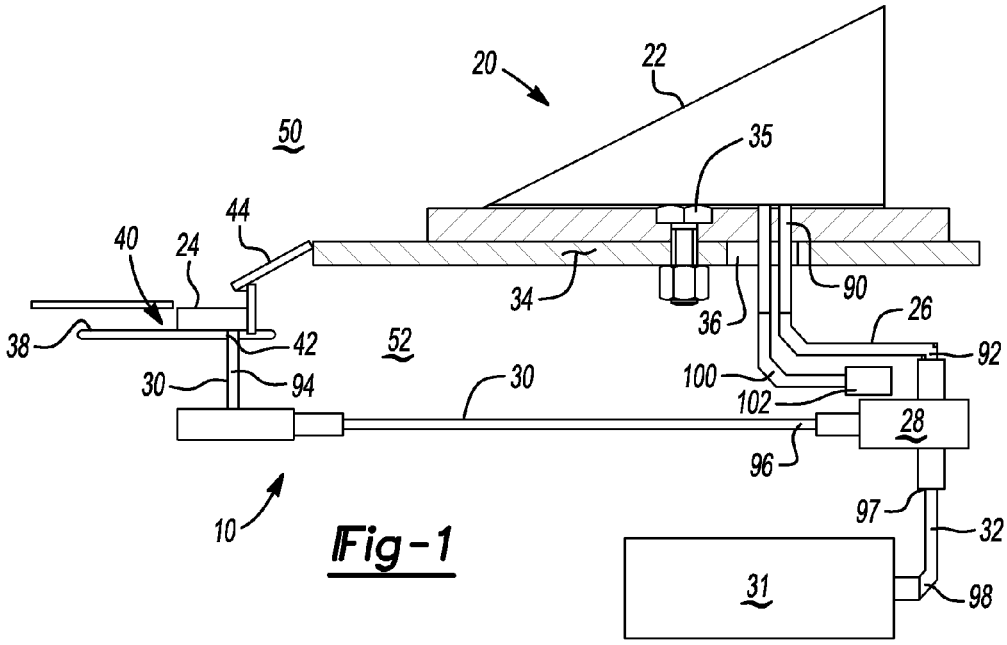
FIG. 1 is a schematic illustration of an exemplary antenna assembly including two antennas on a vehicle.

With reference to FIG. 1, a schematic view of a vehicle is generally indicated by reference number 10, where an antenna system 20 for sending and receiving radio frequency (RF) signals is connected to the vehicle 10. The antenna system 20 includes a primary antenna 22 and a secondary antenna 24 that are each connected to the vehicle 10 and transmit and receive RF signals. The antenna system 20 also includes a first data transmission line 26 used to communicate RF signals between the primary antenna 22 and a fixed RF device 28, as well as a second data transmission line 30 used to communicate RF signals between the secondary antenna 24 and the fixed RF device 28. The fixed RF device 28 is in communication with a vehicle control module 31 through a third data transmission line 32.

FIG. 1 illustrates the primary antenna 22 mounted to a wall 34 of the vehicle 10. Specifically, FIG. 1 shows the primary antenna 22 attached to the wall 34 by a fastener 35, where the fastener 35 may be any type of fastening device for securing the primary antenna 22 to the wall 34 such as, for example, a bolt. The wall 34 has an aperture 36 that allows for the first data transmission line 26 to pass through. In one example, the wall 34 is the roof of the vehicle 10, and is constructed from a metallic material such as, for example, a steel alloy. Moreover, in the embodiment as illustrated, the secondary antenna 24 is located along a second wall 38 that is part of a cowl base 40 of the vehicle 10. The cowl base 40 can also be constructed from a metallic material and includes an aperture 42 for allowing the second data transmission line 30 to pass through. The vehicle 10 also includes several glass panes, such as a front windshield 44, rear windshield 46 (shown in FIG. 2), a sunroof 48 (shown in FIG. 2) and side windows 49 (shown in FIG. 2). In one embodiment, each of the glass panes are coated with a solar management glass coating that attenuates RF signals.

The wall 34, the cowl base 40, and the glass panes define an exterior environment 50 and an interior cabin 52 of the vehicle 10. The exterior environment 50 includes the environment that is located outside of the vehicle 10, while the interior cabin 52 includes the environment within the vehicle 10. The exterior environment 50 is typically any type of outdoor environment. The antennas 22 and 24 are used to send and receive RF signals from an external RF device (not shown) and communicate the RF signals to the control module 31 located within the interior cabin 52. The external RF device can be any type of structure located in the exterior environment 50 that is capable transmitting RF signals, receiving RF signals or both. For example, the external RF device could be a GPS satellite, a cellular telephone tower, an AM radio tower, or an FM radio tower.

In the embodiment as shown in FIG. 1, both the primary antenna 22 and the secondary antenna 24 are located in the exterior environment 50. Specifically, the primary antenna 22 is connected to the roof of the vehicle 10 and the secondary antenna 24 is located in the cowl base 40. However, it is understood that both the primary antenna 22 and the secondary antenna 24 may also be located in other portions of the vehicle 10 as well. For example, the primary antenna 22 can generally be connected to the vehicle 10 and located in a variety of different locations in the exterior environment 50. The secondary antenna 24 can be connected to the vehicle 10 not only in the exterior environment 50 but also within the interior cabin 52 of the vehicle 10 as well. Although FIGS. 1-3B illustrate the antenna system 20 employed in a vehicle, those skilled in the art will appreciate that the antenna system 20 can be used in any application where RF signals are transmitted or received.

Figure 2:
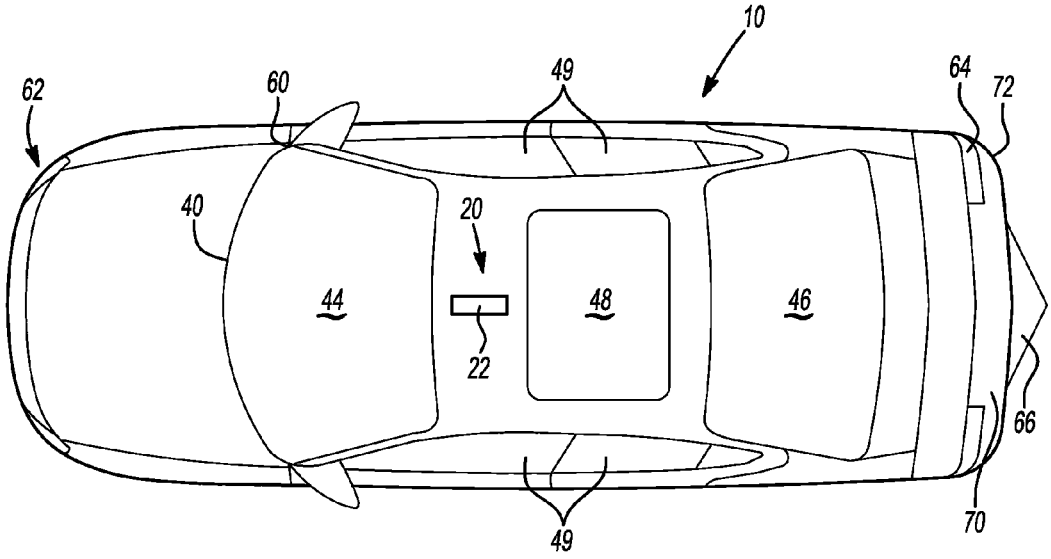
FIG. 2 illustrates an exterior view of the vehicle shown in FIG. 1.
Figure 3A:
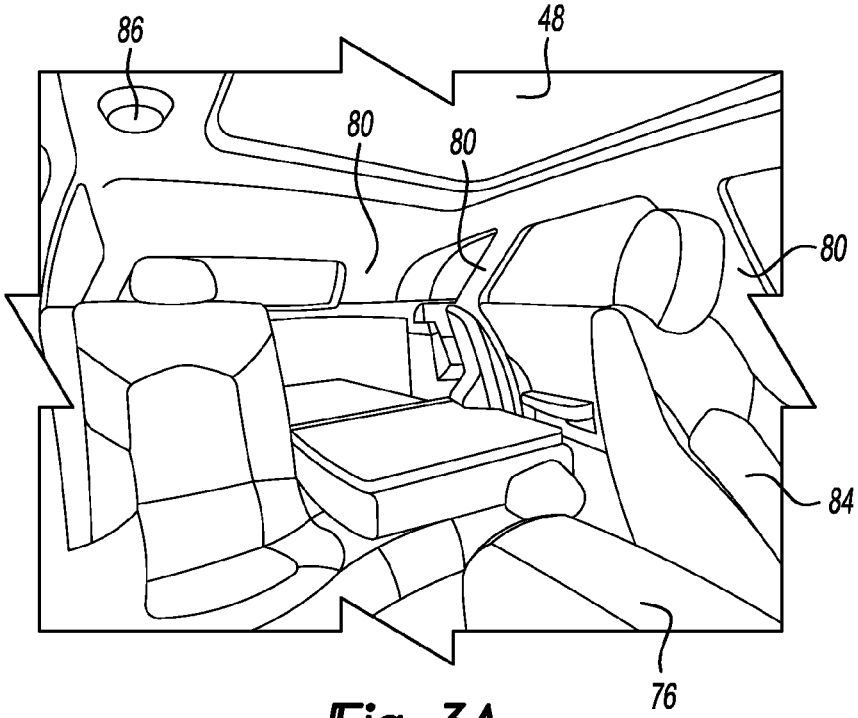
FIG. 3A illustrates a portion of an interior of the vehicle shown in FIG. 1.
Figure 3B:
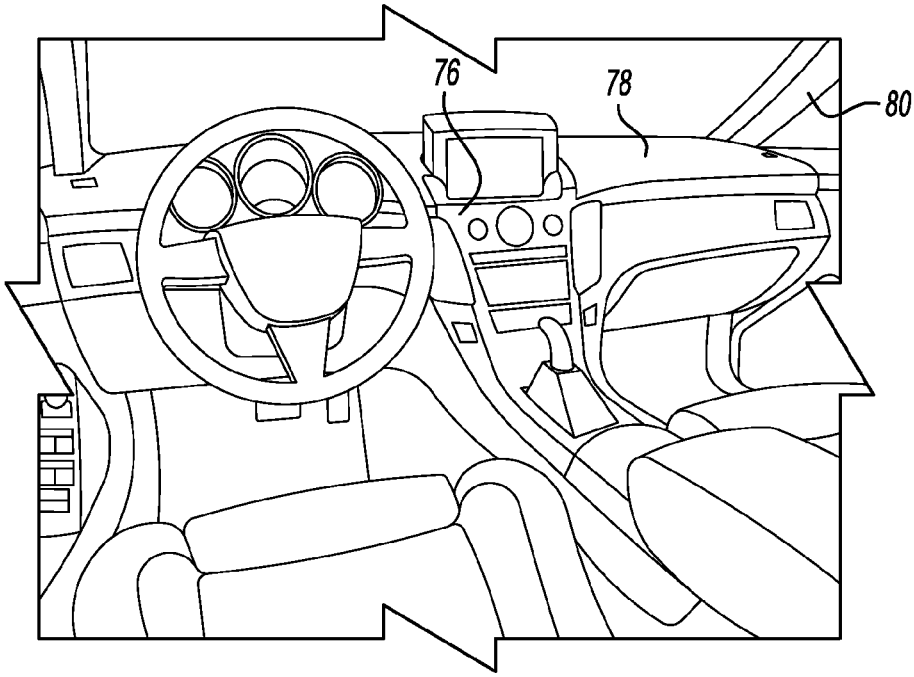
FIG. 3B illustrates another portion of the interior of the vehicle shown in FIG. 1.

Referring now to FIGS. 1-2, both the primary antenna 22 as well as the secondary antenna 24 can be located along any exterior surface of the vehicle 10 that is capable of mounting the antennas 22 and 24 thereon. For example, the antennas 22 and 24 could be mounted to the cowl base 40, a side rearview mirror 60, a head lamp 62, a tail lamp 64, Center High Mounted Stop Lamps (CHMSL) 66, the front windshield 44, the rear windshield 46, the sunroof 48, a deck lid 70, or a bumper 72. In addition to the exterior environment 50, the secondary antenna 24 can be positioned in a variety of locations within the interior cabin 52 that allows for the secondary antenna 24 to receive and transmit RF signals. For example, turning to FIGS. 3A-3B, the secondary antenna 24 could be positioned in a vehicle center console 76, an instrument panel 78, an A, B, C or D pillar 80, an integrated center stack faceplate 82, the front windshield 44 (FIG. 2), the rear windshield 46 (FIG. 2), the sunroof 48, the interior seats 84, or a dome light 86. Thus, while the embodiment in FIG. 1 illustrates the primary antenna 22 as a roof mounted antenna and the secondary antenna 24 located in the cowl base 40, other packaging options for the primary and secondary antennas 22 and 24 exist as well. As a result, the primary and secondary antennas 22 and 24 can be positioned in various locations either in or on the vehicle 10 in an effort to accommodate the unique packaging restraints of a specific vehicle. The locations of the primary and secondary antennas 22 and 24 can also be positioned to accommodate the cable attenuation of the primary and secondary data transmission lines 26 and 30. Specifically, the packaging locations of the primary and secondary antennas 22 and 24 may depend on the available length of the data transmission lines, as a longer data transmission line results in greater signal attenuation.

In the embodiment as shown, the antenna system 20 has a passive design. This means that the primary and secondary antennas 22 and 24 each do not include an amplifier. However, those skilled in the art will appreciate that the antenna system 20 can also include an active design as well, which means the primary and secondary antennas 22 and 24 are amplified. Specifically, the antennas 22, 24 could have an active design using a two-way amplifier. However, it may be more cost effective to employ a passive design in some embodiments as a passive design does not need an amplifier thereby reducing cost as well as complexity of the antenna system 20. Moreover, a passive design does not require vehicle electrical load and would not typically impact electric consumption or power requirements of the vehicle 10.

In the embodiment as shown in FIG. 1, the primary antenna 22 is a fin type antenna and the secondary antenna 24 is illustrated as a patch type antenna, however those skilled in the art will appreciate that other types of antennas may be used as well. Moreover, the primary and secondary antennas 22 and 24 may also be several different antennas that are integrated to receive several different types of RF signals. For example, the primary antenna 22 could include a satellite digital audio radio service (SDARS) antenna, a cellular antenna, and a global positioning system (GPS) antenna. The secondary antenna 24 could include a cellular antenna and a GPS antenna.

In the embodiment as shown, a first end 90 of the first data transmission line 26 is in electrical communication with the fixed RF device 28 and a second end 92 of the first data transmission line 26 is in electrical communication with the primary antenna 22, thereby connecting the primary antenna 22 with the fixed RF device 28. A first end 94 of the second data transmission line 30 is in electrical communication with the fixed RF device 28 and a second end 96 of the second data transmission line 30 is in electrical communication with the secondary antenna 24, thereby connecting the secondary antenna 24 with the fixed RF device 28. A first end 97 of the third data transmission line 32 is in electrical communication with the fixed RF device and a second end 98 of the third data transmission line 32 is in communication with the control module 31, thereby connecting the fixed RF device 28 to the control module 31. The data transmission lines 26, 30 and 32 are any type of data transmission line that carries RF signals such as, for example, a coaxial cable. In one embodiment, the data transmission lines 26, 30 and 32 could each be a combination of multiple data transmission lines for transmitting several different types of RF signals. For example, the data transmission lines 26, 30 and 32 could each be a combination of multiple coaxial cables, where a first coaxial cable transmits a cellular RF signal, a second coaxial cable transmits a GPS RF signal, and a third coaxial cable transmits an SDARS RF signals.

The fixed RF device 28 is employed to generate an output RF signal that is transmitted through the third data transmission line 32 to the control module 31. The output signal generated by the fixed RF device 28 is based on at least one of the RF signals received by the first and second data transmission lines 26 and 30 from the primary and secondary antennas 22 and 24. Specifically, the fixed RF device 28 can include an RF coupler, an RF switch, or both. The RF coupler is any device for combining the RF signals received from the first and second data transmission lines 26 and 30 into a single output signal. Moreover, the fixed RF device 28 could also include an RF splitter for receiving RF signals from the third data transmission lines 32, dividing the RF signal into two separate signals, and sending the divided RF signal to the first data transmission line 26 and the second data transmission line 30. Alternatively, in another embodiment, the fixed RF device 28 could be an RF switch that selects the RF signals from one of the first data transmission line 26 and the second data transmission line 30 to be the output RF signal. Finally, in yet another embodiment, the fixed RF device 28 could include both an RF coupler as well as an RF switch. The fixed RF device 28 would operate as an RF switch if the RF signals from one of the first data transmission line 26 and the second data transmission line 30 are unavailable. Specifically, the fixed RF device 28 would select the RF signals from the particular data transmission line that is receiving RF signals. For example, if the primary antenna 22 is damaged or inoperable, the RF switch would operate to receive RF signals only from the secondary antenna 24. The fixed RF device 28 would also operate as an RF coupler when RF signals from both the first data transmission line 26 and the second data transmission line 30 are available. The fixed RF device 28 could also include multiple RF coupler elements as well as multiple RF switch elements for coupling and switching several different types of RF signals as well. For example, the fixed RF device 28 could include a first RF coupler for combining cellular RF signals and a second RF coupler for combining GPS RF signals.

In one exemplary embodiment, the primary antenna 22 is an integrated antenna including an SDARS antenna, a cellular antenna, and a global positioning system GPS antenna, and the secondary antenna 24 is an integrated antenna including a cellular antenna and a GPS antenna. The RF signals from the SDARS antenna from the primary antenna 22 could be in communication with a fourth data transmission line 100. The fourth data transmission line 100 could be in communication with an SDARS transceiver 102. The cellular RF signals and the GPS RF signals from the primary and secondary antennas 22 and 24 are both communicated through the respective data transmission lines 26 and 30 to the fixed RF device 28. The fixed RF device 28 then provides a corresponding output RF signal for both the cellular RF signal as well as the GPS RF signal. The RF signals are then sent from the fixed RF device 28 through the third data line 32 to the control module 31.

The control module 31 is preferably an electronic control device having a preprogrammed digital computer or processor, control logic, memory used to store data, and at least one I/O peripheral. The control logic includes a plurality of logic routines for monitoring, manipulating, and generating data. The control module 31 may also include circuitry for a transceiver to send and receiver RF signals as well as a modulator/demodulator to convert between RF signals and digital signals. In the exemplary embodiment, the control module 31 is an OnStar® module. The OnStar® module 31 employs cellular data communication as well as location information using GPS technology to contact OnStar® representatives for emergency services, vehicle diagnostics and directions. Although an OnStar® control module is discussed, it is understood that other types of control modules may be used as well such as, for example, an infotainment module.

The secondary antenna 24 can be used to provide a stronger, more reliable RF signal to the control module 31 when compared to an antenna system that employs only one antenna. Moreover, the secondary antenna 24 can also provide a stronger RF signal to the interior cabin of the vehicle as well. Specifically, the secondary antenna 24 can provide a stronger RF signal to the control module 31 if the RF signals received by the primary antenna 22 and the secondary antenna 24 are coupled together by the RF coupler located within the fixed RF device 28. The secondary antenna 24 can also provide a more reliable signal to the control module 31 by operating as a back-up antenna. That is, if the primary antenna 22 is damaged, inoperable or removed, the secondary antenna 24 operates to provide RF signals to the control module 31.

For example, during a vehicle roll-over accident, a primary antenna 22 located on the roof of the vehicle 10 may be crushed. However, the secondary antenna 24 is typically placed in another location, such as the cowl base 40, and remains operable during the roll-over. Therefore, passengers located inside of the vehicle 10 are still able to utilize the OnStar® system to contact representative for emergency services even though the primary antenna 22 is damaged. A solar management glass coating on one or more of the glass panes, such as the front windshield 44, the rear windshield 46 (shown in FIG. 2), and the sunroof 48 (shown in FIG. 2), may also provide an added benefit in this type of emergency situation where RF signals are used to contact emergency services. Specifically, the solar management glass coatings act as a metallic reflector to increase RF signal strength around the exterior environment 50 of the vehicle 10.

In another example, the secondary antenna 24 may also be used as a back-up antenna if the primary antenna 22 is removed from the vehicle 10. Specifically, sometimes thieves break off the primary antenna 22 from the roof of the vehicle 10 in an effort to disable GPS tracking. However, the secondary antenna 24 may be concealed in a location such as the cowl base 40, which can be overlooked by a thief. Thus, the secondary antenna 24 still remains connected to the vehicle 10.

The interior cabin 52 of the vehicle 10 sometimes has weak RF signal reception, as the vehicle 10 has a roof constructed of a metallic material. A weak RF signal may be especially prevalent if the vehicle glass is coated with a solar management glass coating. If a portable electronic device (not shown) that employs RF signals is located within the interior cabin 52 of the vehicle 10, the electronic RF device may sometimes be unable to send or receive RF signals from an external RF device such as a GPS satellite. The portable electronic RF device can be any type of portable electronic device capable of transmitting RF signals such as, for example, a cellular telephone, a laptop computer with a wireless Internet connection, an AM/FM radio, or a personal navigation device (PND). The secondary antenna 24 could be employed in an effort to improve RF signal reception within the interior cabin 52. Specifically, the secondary antenna 24 could be used to receive RF signal from an external RF device, such as a GPS satellite. The secondary antenna 24 could then radiate RF signals from the external RF device into the interior cabin 46, thereby providing a stronger RF signal to the portable electronic RF device.

With continued reference to FIGS. 1-3B, a method for communicating an RF signal with the antenna system 20 is discussed. The method begins at a first step where RF signals are transmitted from the external RF device to the primary antenna 22. The primary antenna 22 is located in the exterior environment 50 and is configured to transmit and receive RF signals from the external RF device. As discussed above, the external RF device is any type of structure that is capable of transmitting RF signals, receiving RF signals, or both. For example, the external RF structure could be a GPS satellite, a cellular telephone tower, and an FM or AM radio tower. The method then proceeds to a second step.

In the second step, the RF signals are communicated from the primary antenna 22 through the data transmission line 26. The first end 90 of the first data transmission line 26 is in electrical communication with the fixed RF device 28 and the second end 92 of the first data transmission line 26 is in electrical communication with the primary antenna 22, thereby connecting the primary antenna 22 with the fixed RF device 28. The method may then proceed to a third step.

In the third step, the secondary antenna 24 is located in either the exterior environment 50 or the interior cabin 52 of the vehicle 10. The secondary antenna 24 is configured to transmit and receive RF signals from the external RF device. The method then proceeds to a fourth step.

In the fourth step, the RF signals are communicated from the secondary antenna 24 through the secondary data transmission line 30. The first end 94 of the second data transmission line 30 is in electrical communication with the fixed RF device 28 and the second end 96 of the second data transmission line 30 is in electrical communication with the secondary antenna 24, thereby connecting the secondary antenna 24 with the fixed RF device 28. The method may then proceed to a fifth step.

In the fifth step, an output RF signal is provided by the fixed RF device 28. The output RF signal is based on the RF signals received from at least one of the primary data transmission line 26 and the secondary data transmission line 30. In one embodiment, the fixed RF device 28 is an RF coupler for combining the RF signals received from the first and second data transmission lines 26 and 30 into a single output signal. Alternatively, in another embodiment, the fixed RF device 28 could be an RF switch that selects the RF signals from one of the first data transmission line 26 and the second data transmission line 30 to be the output RF signal. In yet another embodiment, the fixed RF device 28 could include both an RF coupler as well as an RF switch. The method may then proceed to a sixth step.

In the sixth step, the output RF signal is communicated from the fixed RF device 28 to the control module 31. In one embodiment, the control module 31 is an OnStar® module that employs cellular data communication as well as location information using GPS technology to contact OnStar® representatives for emergency services, vehicle diagnostics and directions. In one embodiment, the method may then proceed back to the first step. For example, OnStar® could then communicate a RF signal to the primary antenna 22 containing information such as, for example, directions from the vehicle's present position to another predetermined destination through a GPS satellite. Alternatively, the method may then terminate.

The description of the invention is merely exemplary in nature and variations that do not depart from the gist of the invention are intended to be within the scope of the invention. Such variations are not to be regarded as a departure from the spirit and scope of the invention.

What is claimed is:

1. An antenna system connectable to a vehicle having an interior cabin, wherein an external RF device is located exterior to the vehicle, and wherein a control module mounted to the vehicle receives an output RF signal from the antenna system, the antenna system comprising:

a primary antenna connected to the vehicle and located in the exterior environment, wherein the primary antenna transmits and receives a first RF signal to and from the external RF device;

a primary data transmission line for transmitting the first RF signal, wherein the primary data transmission line is in communication with the primary antenna;

a secondary antenna connected to the vehicle and located in one of the exterior environment and the interior cabin, wherein the secondary antenna transmits and receives a second RF signal to and from the external RF device located in the exterior environment;

a secondary data transmission line for transmitting the second RF signal, wherein the secondary data transmission line is in communication with the secondary antenna; and a fixed RF device connected to the vehicle and in communication with the primary data transmission line and the secondary data transmission line, wherein the fixed RF device provides the output RF signal, and wherein the output RF signal is based on at least one of the first RF signal and the second RF signal.

2. The antenna system of claim 1 wherein the fixed RF device is an RF coupler for combining the first RF signal and the second RF signal to create the output RF signal.

3. The antenna system of claim 1 wherein the fixed RF device is an RF switch for selecting the one of the first RF signal and the second RF signal as the output RF signal.

4. The antenna system of claim 1 wherein the fixed RF device is a combined RF switch and an RF coupler, wherein the fixed RF device operates as an RF switch if one of the first RF signal and the second RF signal is unavailable, and wherein the fixed RF device operates as an RF coupler when the first RF signal and the second RF signal are available.

5. The antenna system of claim 1 wherein the primary antenna is located on one of a roof of the vehicle, a cowl base, a side rearview mirror, a head lamp, a tail lamp, Center High Mounted Stop Lamps (CHMSL), a front windshield, a rear windshield, a sunroof, a deck lid, and a bumper.

6. The antenna system of claim 1 wherein the secondary antenna is located on one of a roof of the vehicle, a cowl base, a side rearview mirror, a head lamp, a tail lamp, Center High Mounted Stop Lamps (CHMSL), a front windshield, a rear windshield, a sunroof, a deck lid, and a bumper.

7. The antenna system of claim 1 wherein the secondary antenna is located within the interior cabin of the vehicle, and on one of a vehicle overhead console, a vehicle center console, an instrument panel, an A pillar, a B pillar, a C pillar, a D pillar, an integrated center stack faceplate, a front windshield, a rear windshield, a sunroof, interior seats and a dome light.

8. The antenna system of claim 1 wherein the fixed RF device is in communication with the control module through a third data transmission line.

9. The antenna system of claim 1 wherein the primary antenna and the secondary antenna are each integrated antennas including several different antenna elements.

10. The antenna system of claim 1 wherein at least one of the primary antenna and the secondary antenna are passive antennas.

11. The antenna system of claim 1 wherein the data transmission line is a coaxial cable.

12. The antenna system of claim 1 wherein the secondary antenna is in bidirectional communication with an interior RF device located within the interior cabin.

13. An antenna system connectable to a vehicle having an interior cabin, wherein an external RF device is located exterior to the vehicle, and wherein a control module mounted to the vehicle receives an output RF signal from the antenna system, the antenna system comprising:

a primary antenna connected to the vehicle and located in the exterior environment, wherein the primary antenna transmits and receives a first RF signal to and from the external RF device;

a primary data transmission line for transmitting the first RF signal, wherein the primary data transmission line is in communication with the primary antenna;

a secondary antenna connected to the vehicle and located in one of the exterior environment and the interior cabin, wherein the secondary antenna transmits and receives a second RF signal to and from the external RF device located in the exterior environment;

a secondary data transmission line for transmitting the second RF signal, wherein the secondary data transmission line is in communication with the secondary antenna; and a fixed RF device connected to the vehicle and in communication with the primary data transmission line and the secondary data transmission line, wherein the fixed RF device includes at least one of an RF switch and an RF coupler, wherein the RF coupler combines the first RF signal and the second RF signal to create the output RF signal, and wherein the RF switch for selects one of the first RF signal and the second RF signal as the output RF signal.

14. The antenna system of claim 13 wherein the primary antenna is located on one of a roof of the vehicle, a cowl base, a side rearview mirror, a head lamp, a tail lamp, Center High Mounted Stop Lamps (CHMSL), a front windshield, a rear windshield, a sunroof, a deck lid, and a bumper.

15. The antenna system of claim 13 wherein the secondary antenna is located on one of a roof of the vehicle, a cowl base, a side rearview mirror, a head lamp, a tail lamp, Center High Mounted Stop Lamps (CHMSL), a front windshield, a rear windshield, a sunroof, a deck lid, and a bumper.

16. The antenna system of claim 13 wherein the secondary antenna is located within the interior cabin of the vehicle, and on one of a vehicle overhead console, a vehicle center console, an instrument panel, an A pillar, a B pillar, a C pillar, a D pillar, an integrated center stack faceplate, a front windshield, a rear windshield, a sunroof, interior seats and a dome light.

17. The antenna system of claim 13 wherein the fixed RF device is in communication with the control module through a third data transmission line.

18. The antenna system of claim 13 wherein the primary antenna and the secondary antenna are each integrated antennas including several different antenna elements.

19. The antenna system of claim 13 wherein the secondary antenna is in bidirectional communication with an interior RF device located within the interior cabin.

20. An antenna system connectable to a vehicle having an interior cabin, wherein the vehicle has glass panes that are coated with a solar management glass coating that attenuates RF signals into the interior cabin, wherein an interior RF device is located within the interior cabin, and wherein a control module mounted to the vehicle receives an output RF signal from the antenna system, the antenna system comprising:

a primary antenna connected to the vehicle and located in the exterior environment, wherein the primary antenna transmits and receives a first RF signal to and from the external RF device;

a primary data transmission line for transmitting the first RF signal, wherein the primary data transmission line is in communication with the primary antenna;

a secondary antenna connected to the vehicle and located in one of the exterior environment and the interior cabin, wherein the secondary antenna transmits and receives a second RF signal to and from the external RF device located in the exterior environment, and wherein the secondary antenna is in bidirectional communication with the interior RF device located within the interior cabin;

a secondary data transmission line for transmitting the second RF signal, wherein the secondary data transmission line is in communication with the secondary antenna; and a fixed RF device connected to the vehicle and in communication with the primary data transmission line and the secondary data transmission line, wherein the fixed RF device includes at least one of an RF switch and an RF coupler, wherein the RF coupler combines the first RF signal and the second RF signal to create the output RF signal, and wherein the RF switch for selects one of the first RF signal and the second RF signal as the output RF signal; and a third data transmission line for transmitting RF signals, wherein the third data transmission line is in communication with the control module and the fixed RF device for transmitting the RF output signal from the fixed RF device to the control module.

* * * * *